United States Patent [19]

Mori

[11] Patent Number: 4,854,712

[45] Date of Patent: Aug. 8, 1989

[54] MULTI-COLOR LUMINOUS STIRRER

[75] Inventor: Yasumasa Mori, Nagano, Japan

[73] Assignee: Chikuma Kouki Co., Ltd., Nagano, Japan

[21] Appl. No.: 181,645

[22] Filed: Apr. 14, 1988

[30] Foreign Application Priority Data

Jun. 2, 1987 [JP] Japan ..... 62-86116

[51] Int. Cl.[4] ..... B01F 15/00

[52] U.S. Cl. ..... 366/129; D7/42; 362/120; 366/142; 366/343

[58] Field of Search ..... 366/129, 130, 142, 144, 366/279, 342, 343, 349; 362/109, 115, 116, 120, 227, 234; 73/304 R; 200/61.04; D7/42

[56] References Cited

U.S. PATENT DOCUMENTS

| | | | |
|---|---|---|---|
| D. 149,499 | 5/1948 | Holden | D7/42 |
| 2,820,263 | 1/1958 | Fruengel | 366/129 X |
| 3,076,638 | 2/1963 | Grise | 366/130 |
| 3,316,368 | 4/1967 | Veau | 200/61.04 |
| 3,584,327 | 6/1971 | Murry | 366/129 X |
| 3,975,582 | 8/1976 | Ford | 73/304 R |
| 4,065,107 | 12/1977 | Van Horbeck | 366/343 |
| 4,283,757 | 8/1981 | Nalbandian et al. | 362/120 |
| 4,480,295 | 10/1984 | Shuster | 362/120 |
| 4,483,622 | 11/1984 | Muhi et al. | 366/129 |

*Primary Examiner*—Timothy F. Simone
*Attorney, Agent, or Firm*—Koda and Androlia

[57] ABSTRACT

A multi-color luminous stirrer including a handle housing therein a battery and a shank composed of two tubular-shaped electrodes coupled together mechanically through an insulating ring. When the tubular-shaped electrodes are submerged in a drink, a switching circuit is actuated and in accordance with the movement of an electroconductive ball placed freely on a flat electrode that is connected to the battery and encircled by curved electrodes which are electrically connected to a plurality of illuminants housed at the top of the shank by transparent or translucent cap, On and OFF states are created between the electrodes. Thus, the illuminants emit light at random. The tubular-shaped shank may alternately be formed of a highly heat conductive material, with a bimetal housed therein so that when the tubular-shaped shank is dipped in a drink which is different in temperature from that of the ambient air, the switching circuit is actuated.

5 Claims, 4 Drawing Sheets

MULTI-COLOR LUMINOUS STIRRER

BACKGROUND OF THE INVENTION

1. Field of the Invention

The present invention relates to a multi-color luminous stirrer and, more particularly, to a multi-color luminous stirrer which, while stirring drinks in a glass, emits multi-color light randomly from the tip portions thereof, which reflects on the drink and glass thereby appealing to the aesthetic sense of the observer.

2. Prior Art

When drinking whiskey diluted with water, a highball, or other soft drinks, such drinks are generally stirred with a stirrer. Even when drinking mixed cocktails such as a Bloody Mary or Margarita, stirrers are usually used. Such frequently used conventional stirrers have various types of decorative designs. For example, some stirrers are shaped like golf clubs, etc. Through the skillful use of plastic and glass materials, stirrers with a great variety of decorative designs are produced and put into a wide range of uses.

However, although conventional stirrers provide drinkers with aesthetic enjoyment, the decorative designs thereof have been limited to the shape of the stirrer and no conventional stirrer has given visual pleasure to the user by emitting multicolor light.

SUMMARY OF THE INVENTION

Accordingly, the object of the present invention is to provide a multi-color luminous stirrer capable of giving perceptual pleasure to the user by providing the stirrer with a light emitting function and, particularly, with the function of emitting such multi-colored light randomly.

The foregoing object of the invention is achieved by giving the stirrer the following structural features.

The multi-color luminous stirrer of the present invention has a plural number of illuminants protected by a transparent or translucent sealing material housed at the tip of a tubular-shaped shank supported by a handle. The stirrer is further designed so that the illuminants emit light when supplied with electricity from a battery housed in the handle.

In the multi-color luminous stirrer of the present invention, two tubular-shaped electrodes are connected mechanically through an insulating ring disposed therebetween so as to constitute a tubular-shaped shank, so that the switching circuit is actuated when the tubular-shaped electrodes are submerged in a liquid such as water.

Furthermore, in this multi-color luminous stirrer, the tubular-shaped shank is made of tubular material with a high thermal conductivity, and a bimetal is housed within the tubular shank such that the switching circuit is actuated when the tubular-shaped shank is submerged in water having a temperature different from the ambient air.

In addition, a flat electrode connected to the battery is provided for the switching circuit so as to be surrounded by the curved electrodes which are electrically connected to the illuminants such that, an ON or OFF state is created between the electrodes causing the illuminants to randomly emit light in accordance with the movement of an electroconductive sphere placed on the flat electrode.

BRIEF DESCRIPTION OF THE DRAWINGS

The Figures show embodiments in accordance with the teachings of the present invention.

DETAILED DESCRIPTION OF THE INVENTION

Figure 1:
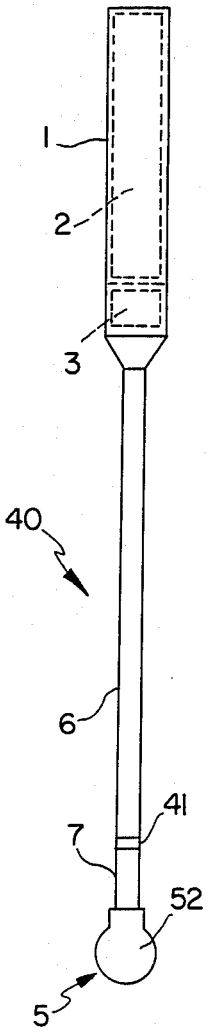
FIG. 1 is a front view of a multi-color luminous stirrer according to the present invention.
Figure 2:
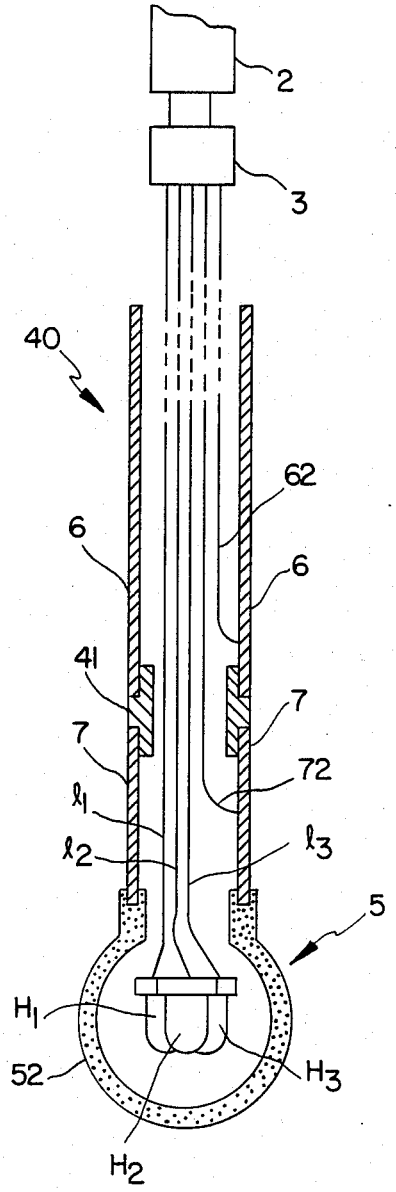
FIG. 2 is a partial enlargement of a cross section of the stirrer shown in FIG. 1.

Hereunder, a description of the structure of the present invention will be provided with reference to the drawings.

The Figures show the embodiments of the invention, and in the Figures, like elements in the other embodiment are denoted by the like reference numerals and symbols.

Referring first to FIGS. 1 through 8, a description will be given of the first embodiment.

At the tip portion of a tubular-shaped shank 40 supported by a handle 1, a plurality of illuminants H1, H2 and H3 which are protected by a transparent or translucent sealing cap 52 are housed. The illuminants H1, H2 and H3 emit light at random by the electric power supplied from a battery 2 housed inside the handle 1.

The handle 1 is formed of the insulating material, such as plastic or glass, and has an insulating ring 41 disposed between two tubular-shaped electrodes 6 and 7 which are mechanically coupled, thereby forming the tubular-shaped shank 40. A light emitting portion 5 at the tip end is formed of the plurality of illuminants H1, H2 and H3.

When the two tubular-shaped electrodes 6 and 7 are dipped in a drink, a switching circuit 3 is actuated. More specifically, when the two tubular-shaped electrodes 6 and 7 are submerged in the drink, a low resistance is created by the water contained in the drink exists between the electrodes 6 and 7. Consequently, electric current flows to the base of a switching transistor Tr by passing through the tubular-shaped electrodes 6 and 7. As a result, a collector and emitter are electrically connected. Thus, electric current flows at random to one or two of the illuminants H1, H2 and H3 and a light emitting diode current limiting resistance R, causing the illuminants H1, H2 and H3 to emit light randomly. The illuminants H1, H2 and H3 can be composed of light emitting diodes, lamps, or electroluminescences which emit different colors of light.

The illuminants H1, H2 and H3 emit light at random via electrodes which are constructed as described below.

In the switching circuit 3, an electroconductive ball K is placed freely on a flat electrode C which is connected to the battery 2 and surrounded by curved electrodes D1, D2 and D3 which in turn are connected electrically to a plural number of illuminants H1, H2 and H3, respectively. Thus, the ON or OFF state is brought about between the foregoing electrodes in accordance with the movement of the stirrer and the ball K, as shown in FIG. 3 through FIG. 7. As a result, the illuminants H1, H2 and H3 emit light a random.

More specifically, when the drink in the glass is stirred by the multi-color luminous stirrer of this invention, the electroconductive ball K rolls and comes into contact with one or two of the electrodes D1, D2 and D3. As a result, electric current flows from the electrode C, through the electroconductive ball K, to one of the electrodes D1, D2 and D3, or a combination of these electrodes (for example, D1 and D2, D1 and D3 or D2 and D3), thereby causing the corresponding illuminants H1, H2 and H3 to emit light.

Figure 3:
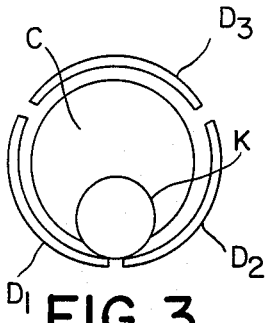
FIGS. 3, 4 and 7 are plan views of the electrodes which change the luminescent colors.
Figure 5:
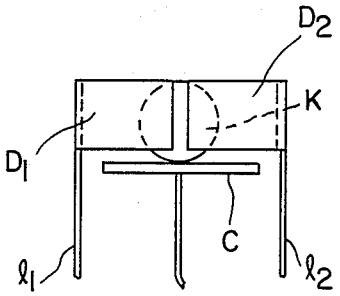
FIGS. 5 and 6 are front views of the electrodes which change the luminescent colors.

For example, in the case shown in FIGS. 3 and 5, the electroconductive ball K causes the electrodes D1 and D2 to be electrically connected to the electrode C, thereby turning on the illuminants H1 and H2.

Figure 4:
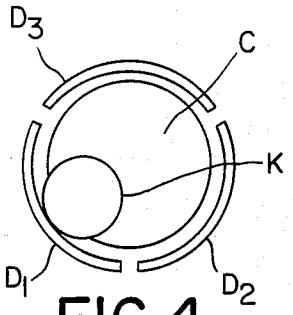
Figure 6:
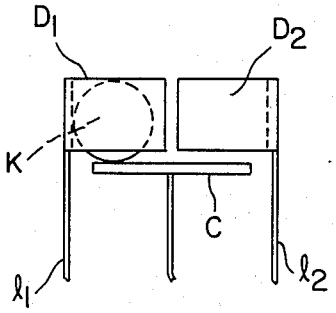

In the case shown in FIGS. 4 and 6, the electroconductive ball K causes the electrode D1 to be electrically connected to the electrode C, and thus, turns on the illuminant H1.

Figure 7:
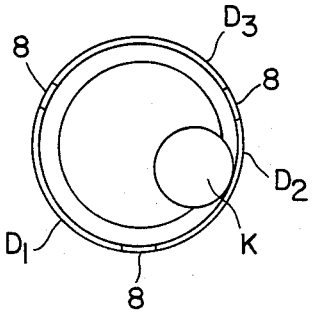
Figure 8:
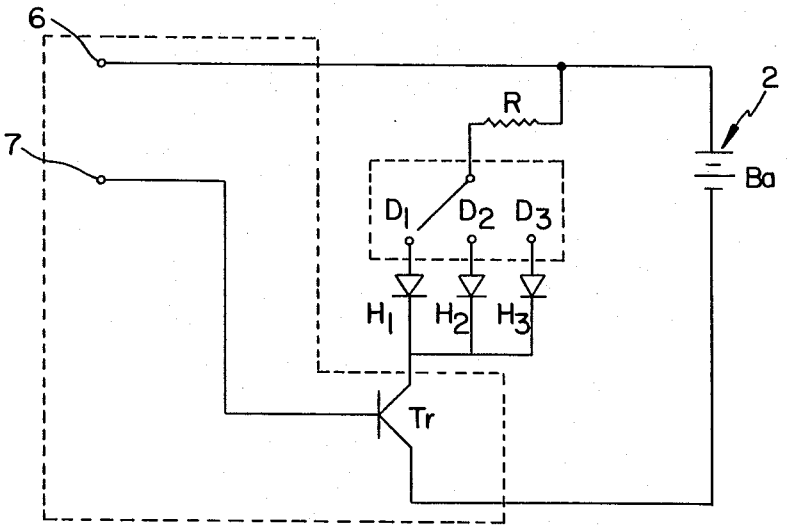
FIG. 8 is a diagram of a switching circuit which changes the luminescent colors.

In the case shown in FIG. 7, since insulating members 8 are provided between the electrodes D1, D2 and D3, respectively, the electroconductive ball K does not cause two electrodes among the electrodes D1, D2 and D3 to be electrically charged at the same time as shown in FIGS. 3 and 5, so that two beams of light with mutually different colors are not emitted simultaneously.

In the Figures, reference numerals 62 and 72 denote lead wires leading from the electrodes 6 and 7 to the switching circuit 3, and reference numerals 11, 12 and 13 designate lead wires from the switching circuit 3 to the illuminants H1, H2 and H3, respectively.

Another embodiment of a multi-color luminous stirrer according to this invention will now be explained with reference to FIGS. 9 through 11.

Figure 9:
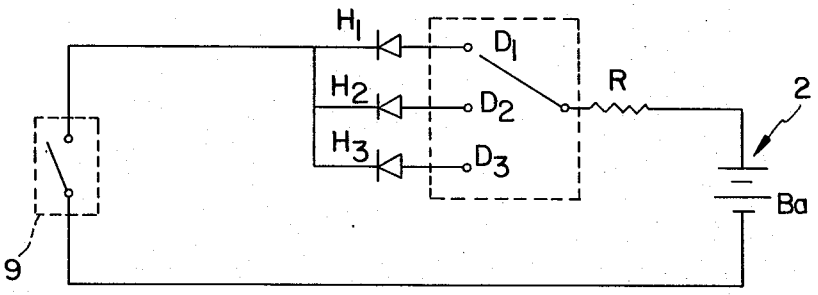
FIG. 9 is a diagram of a switching circuit which changes the luminescent colors in another embodiment.
Figure 10:
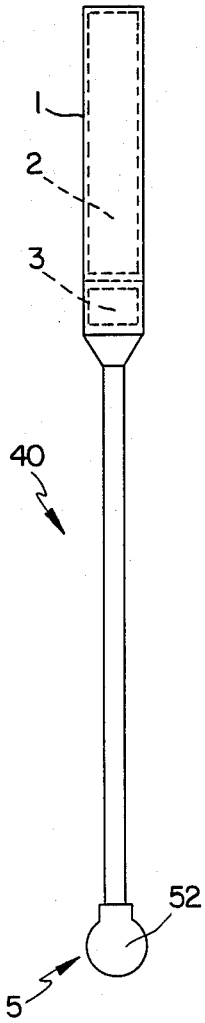
FIG. 10 is a front view of a multi-color luminous stirrer of another embodiment according to the present invention.
Figure 11:
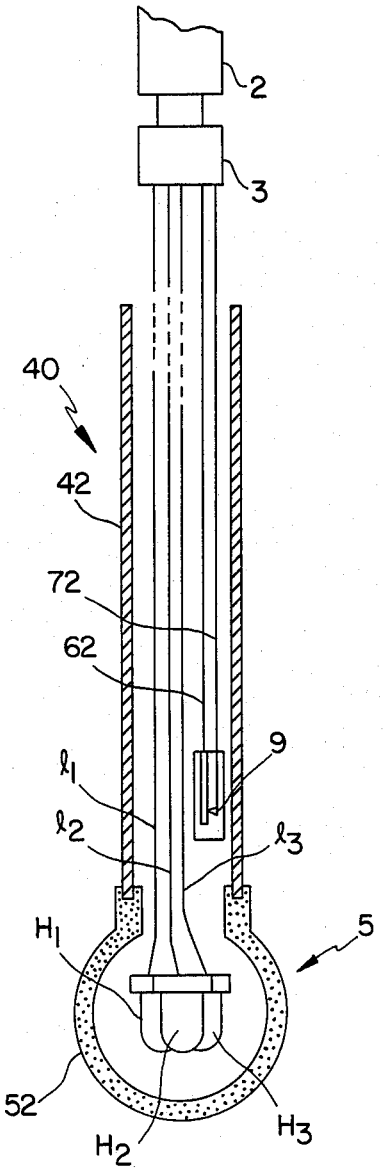
FIG. 11 is a partially enlarged cross sectional view of the stirrer shown in FIG. 10.

In the embodiment shown in FIGS. 9 through 11 the tubular-shaped shank 40 is formed of a tubular material that is high in thermal conductivity. Inside of the tubular-shaped shank 40, a bimetal 9 is housed. When the tubular-shaped shank 40 is dipped in a drink which is different in temperature from the ambient air, the shape form of the bimetal 9 changes, and the bimetal 9 comes into contact with a contact, causing the switching circuit 3 to operate. Aside from this feature, the other components such as the electrodes D1, D2, and D3 and the illuminants H1, H2 and H3 are the same as those in the first embodiment.

The multi-color luminous stirrer according to the present invention has the structure described above. Accordingly, the stirrer itself emits light and, in addition, multi-color light is emitted at random from the stirrer. Thus, the stirrer can entertain the user by creating a visually pleasurable effect due to the beautiful glow of the drink and glass reflecting the multi-color light emitted from the stirrer and scintillating against those light.

I claim:

1. A multi-color luminous stirrer comprising:

a plurality of illuminants housed in the tip portion of a tubular-shaped shank supported by a handle and protected by a transparent or translucent sealing material; and a battery housed in said handle so as to cause said illuminants to randomly emit light by supplying electricity therefrom; and wherein said tubular-shaped shank is constructed by mechanically coupling two tubular-shaped electrodes through an insulating ring and electrically coupling said electrodes to said battery so that a switching circuit for causing said illuminants to randomly emit light is provided with electricity from said battery when tubular-shaped electrodes are submerged in a liquid.

2. A multi-color luminous stirrer comprising:

a plurality of illuminants housed in the tip portion of a tubular-shaped shank supported by a handle and protected by a transparent or translucent sealing material; and a battery housed in said handle so as to cause said illuminants to randomly emit light by supplying electricity therefrom; and wherein said tubular-shaped shank is formed of a highly heat conductive material, and a bimetal switch is housed in said tubular-shaped shank and electrically coupled to said battery so that a switching circuit for causing said illuminants to randomly emit light is provided with electricity from said battery when said tubular-shaped shank is dipped in liquid having a temperature different from that of ambient air.

3. A multi-color luminous stirrer according to claim 1, wherein said switching circuit for causing said illuminant to randomly emit light comprises an electroconductive ball placed freely on a flat electrode connected to said battery and encircled by curved electrodes connected electrically to said plurality of illuminants.

4. A multi-color luminous stirrer comprising:

a handle containing therein a power source and a switching circuit;

a shank connected at one end to said handle; and a cap mounted at the other end of said shank, said cap containing a plurality of illuminants which are connected to said switching circuit and emit light of different colors; and wherein:

said switching circuit comprises:

a plurality of circular electrodes arranged side by side, each of said electrodes being connected to one of said illuminants;

a flat electrode provided beneath said circular electrodes and connected to said power source; and an electroconductive ball placed on said flat electrode such that said electroconductive ball electrically connects said circular electrodes and said flat electrode; and said shank comprises two tubular-shaped electrodes connected at the ends with an insulator therebetween, said two tubular-shaped electrodes being coupled to said source of power and for supplying power from said power source to said switching circuit when said stirrer is submerged in a liquid.

5. A multi-color luminous stirrer according to claim 4, further comprising insulators provided between said plurality of circular electrodes.

* * * * *